United States Patent [19]

Yamamura et al.

[11] Patent Number: 5,008,937

[45] Date of Patent: Apr. 16, 1991

[54] SCRAMBLED-COMMUNICATION SYSTEM USING ADAPTIVE TRANSVERSAL FILTERS FOR DESCRAMBLING RECEIVED SIGNALS

[75] Inventors: Yoshihiro Yamamura; Takashi Ogihara; Yoshinobu Nakanishi; Tomohiro Nishizono, all of Tokyo, Japan

[73] Assignee: NEC Corporation

[21] Appl. No.: 371,209

[22] Filed: Jun. 26, 1989

[30] Foreign Application Priority Data

Jun. 25, 1988 [JP] Japan ..... 63-156012
Feb. 8, 1989 [JP] Japan ..... 1-30851

[51] Int. Cl.[5] ..... H04K 1/02

[52] U.S. Cl. ..... 380/50; 380/6; 380/9; 380/33; 380/40; 380/46; 364/724.16

[58] Field of Search ..... 380/6, 9, 33, 35, 40, 380/46, 21, 49, 50; 364/514, 724.16; 333/165, 166

[56] References Cited

U.S. PATENT DOCUMENTS 3,624,562 11/1971 Fujimura ..... 364/514 X
4,398,062 8/1983 McRae et al. ..... 380/21

*Primary Examiner*—Stephen C. Buczinski
*Assistant Examiner*—Bernarr Earl Gregory
*Attorney, Agent, or Firm*—Ostrolenk, Faber, Gerb & Soffen

[57] ABSTRACT

In a scrambled-communication system, a transmitting station generates a scrambling noise having a periodically-recurrent series of noise patterns and scrambles an information signal by simply summing the scrambling noise to the information signal, whereby the information signal is totally unintelligible by an interceptor. At a receiving station, a noise-cancelling signal is generated by an adaptive transversal filter and supplied to a subtractor where it is combined with the scrambled signal to recover the information signal. For generating the noise-cancelling signal, a descrambling noise identical to the scrambling noise is generated. The filter has a tapped-delay line for receiving the descrambling noise and a plurality of variable tap weights connected respectively to taps of the tapped-delay line. The outputs of the tap weights are summed to produce the noise-cancelling signal which corresponds to the scrambling noise if the tap weights are adjusted to optimum tap coefficients that are derived from the descrambling noise and from the output of the subtractor. The repetition frequency and noise pattern are the key for descrambling the scrambled signal.

10 Claims, 4 Drawing Sheets

TO D/A CONV. 18
$e_j$
15
COEFFICIENT DECISION CIRCUIT
$\Delta h(i)_j$
17
$Y_j$
FROM A/D CONVERTER 16
14
21-1
21-2
21-3
21-(n-2)
21-(n-1)
$X_{j-1}$
$X_{j-N+1}$
$Z^{-1}$
$h(0)_j$
$h(1)_j$
$h(2)_j$
$h(3)_j$
$h(N-2)_j$
$h(N-1)_j$
22-0
22-1
22-2
22-3
22-(n-2)
22-(n-1)
23
$\hat{Y}_j$
$X_j$
FROM PN SEQ. GEN. 13

SCRAMBLED-COMMUNICATION SYSTEM USING ADAPTIVE TRANSVERSAL FILTERS FOR DESCRAMBLING RECEIVED SIGNALS

BACKGROUND OF THE INVENTION

The present invention relates to an analog scrambling/descrambling system.

Known analog scrambling/descrambling techniques are generally of two types, i.e., scrambling in the frequency domain and scrambling in the time domain. One of the earliest forms of frequency scrambling is simply interchanging the low and high frequencies of a speech signal that is band-limited to the range 300 to 3400 Hertz. A sophisticated form of frequency scrambling is the bandscrambler which divides the spectrum of a signal into a number of equal sub-bands and the signal is then scrambled by rearranging their order. Information identifying the number of sub-bands and the order of rearrangement is the key for descrambling the signal. Scramblers operating in the time domain are called time-element scramblers in which an analog signal is first divided into equal time periods called frames. Each frame is then sub-divided into small, equal time periods, or segments. The segments of each frame are then scrambled by rearranging their order.

U.S. Pat. No. 4,068,094 discloses a scrambling/descrambling technique that combines the frequency scrambling and time domain scrambling techniques.

However, in any of the prior art scrambling/descrambling techniques, there is a correlation between the amplitudes of the original speech signal and those of the scrambled signal. Because of this correlation, the rise and fall of the pitch of the transmitted spoken message are detectable by an interceptor. From the detected intonation, the interceptor can give a rough judgment of the contents of the message.

SUMMARY OF THE INVENTION

It is, therefore, an object of the present invention to provide an analog scrambling/descrambling system that prevents interceptors from making any valid judgment of the contents of a transmitted spoken message by eliminating correlation between the amplitudes of the original information signal and those of the scrambled signal.

According to a first aspect of the present invention, there is provided a scrambled communication system which comprises a transmitting station and a receiving station. The transmitting station comprises a source noise generator for generating a scrambling noise having a periodically-recurrent series of noise patterns. An information signal is scrambled by simply adding the noise to the information signal using an adder. In addition, the level setting of the scrambling noise is such that it completely masks the information signal and renders it totally unintelligible by an interceptor. At the receiving station, a noise-cancelling signal is generated by an adaptive transversal filter and supplied to a subtractor where it is combined with the scrambled signal to produce a descrambled signal. For generating the noise-cancelling signal, a local noise generator is provided that generates descrambling noise having a periodically-recurrent series of noise patterns identical to the scrambling noise used at the transmitting station. The adaptive transversal filter has a tapped-delay line connected to the local noise generator and a plurality of variable-tap weights connected respectively to taps of the tapped-delay line. The number of variable-tap weights determines the length of the transversal filter and must be greater than the interval between successive series of noise patterns of the descrambling noise. The outputs of the tap weights are summed to produce the noise-canceling signal, which corresponds to the scrambling noise if the tap weights are adaptively adjusted to optimum tap coefficients. The optimum tap coefficients are derived by a decision circuit from the descrambling noise and from the output of the subtractor. The repetition frequency and noise pattern of the source- and local-noise generators are the key to the scrambled communication system.

According to a second aspect of the present invention, there is provided a scrambling/descrambling station for two-way communication. The scrambling/descrambling station comprises a source-noise generator for generating a scrambling noise having a periodically-recurrent series of noise patterns. The scrambling noise is added to an information signal to produce a scrambled signal, which appears at a first port of a hybrid and is coupled via a transmission medium to the distant station. A scrambled signal from the distant station is coupled via the transmission medium to a second port of the hybrid. A first subtractor is provided for subtracting a first noise-cancelling signal from the signal at the second port of the hybrid. A local noise generator generates a descrambling noise having a periodically-recurrent series of noise patterns and applies it to a first adaptive transversal filter, which includes a tapped-delay line connected to the local noise generator means and a plurality of variable-tap weights connected respectively to taps of the tapped-delay line. The outputs of the tap weights are summed and applied as the first noise-cancelling signal to the first subtractor. The first adaptive transversal filter has a filter length greater than the interval between successive series of noise patterns of the descrambling noise. First tap coefficients are derived from the descrambling noise and from the output of the first subtractor to adjust the tap weights of the first adaptive transversal filter; in this way, the first noise-cancelling that is signal corresponds to the noise introduced to the signal scrambled by the distant station.

The output of the first subtractor is further connected to a second subtractor for subtracting from it a second noise-cancelling signal. A second adaptive transversal filter is provided having a tapped-delay line connected to the source noise generator and a plurality of variable-tap weights connected respectively to taps of the tapped-delay line. The second adaptive transversal filter has a filter length greater than the interval between successive series of the noise patterns of the scrambling noise. The outputs of the tap weights of the second transversal filter are summed and applied as the second noise-cancelling signal to the second subtractor. Second tap coefficients are derived from the scrambling noise and from the output of the second subtractor to adjust the tap weights of the second adaptive transversal filter so that the second noise-cancelling signal corresponds to the noise which is undesirably mixed with the received signal by the transhybrid coupling.

BRIEF DESCRIPTION OF THE DRAWINGS

The present invention will be described in further detail with reference to the accompanying drawings, in which.

DETAILED DESCRIPTION

Figure 1:
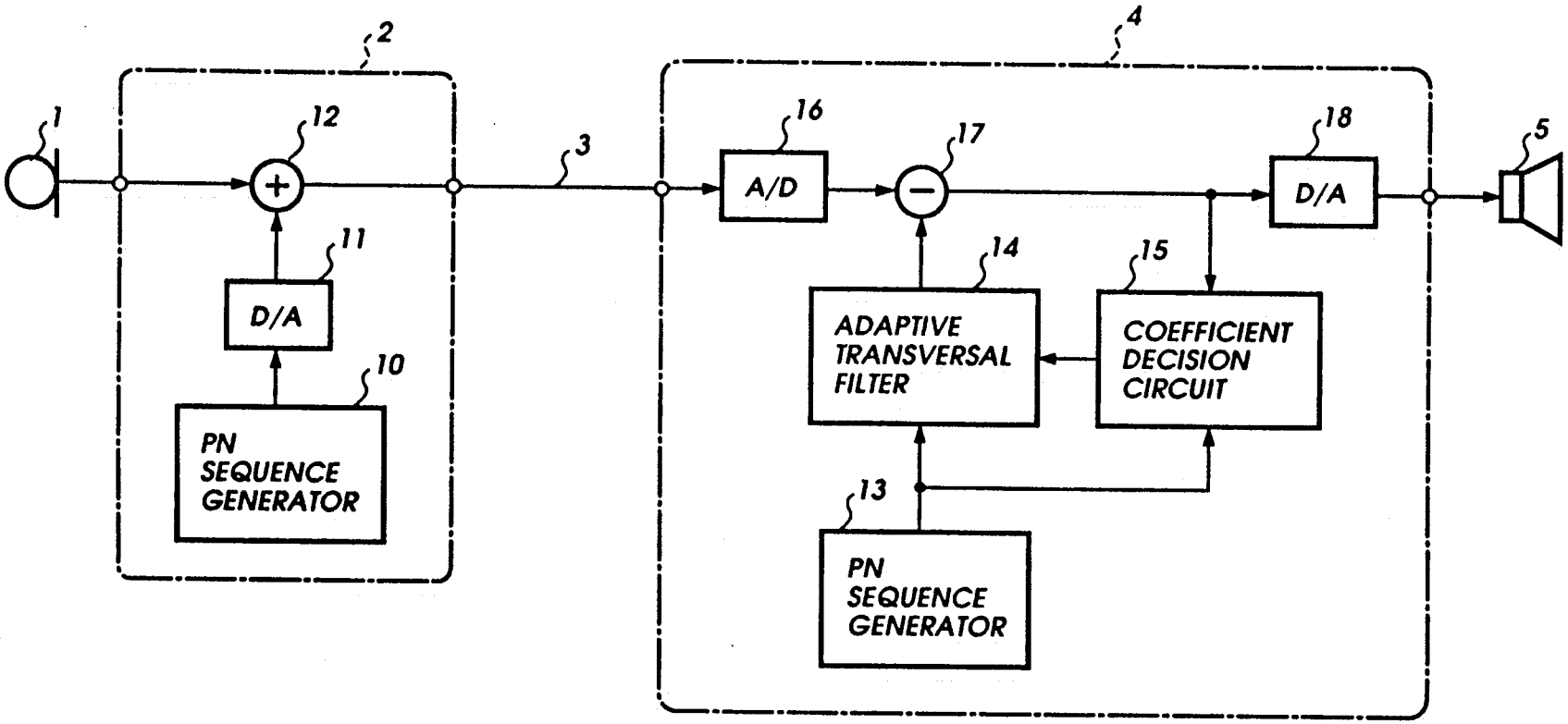
FIG. 1 is a block diagram of a one-way scrambling-/descrambling communication system according to a first embodiment of the present invention.

Referring now to FIG. 1, there is shown a simplified communication system for scrambled transmission of signals whose frequency spectrum lies within the transmission bandwidth of typical telephone lines, i.e., 300 Hz to 3400 Hz. Speech signals from an input transducer such as microphone 1 are transmitted by a transmitting station, or scrambling circuit, 2 via a transmission line 3 to a receiving station, or descrambling circuit, 4 to which an output transducer such as loudspeaker 5 is connected.

The scrambling circuit 2 includes a pseudorandom number (PN) generator 10 for generating a periodically-recurrent series of pseudorandom bit patterns. This pseudorandom bit patterns are converted to analog form by a digital-to-analog converter 11 and added to the speech signal by an adder 12 as a scrambling noise signal, and the scrambled speech signal is transmitted via the transmission line 3 to the receiving station 4. The spectral energy densities of the analog noise so introduced to the speech signal are substantially constant over the full bandwidth of the transmission line. The ratio of the level of speech signal to the level of the scrambling noise, or signal-to-noise (S/N) ratio, is preferably set equal to −20 dB. With the S/N ratio of this value, sound articulation is reduced to 0%, i.e., the speech signals are rendered completely unintelligible by the scrambling noise.

The descrambling circuit 4 is provided with an analog-to-digital converter 16 for converting the scrambled analog signal to digital form for coupling to one input terminal of a subtractor 17. A descrambling noise source, or pseudorandom number generator 13, which is identical to the scrambling noise source 10, is provided to supply a pseudorandom sequence to an adaptive transversal filter 14 and to a coefficient decision circuit 15 to which the output of subtractor 17 is also applied. The output of transversal filter 14 is applied to another input terminal of subtractor 17 to cancel the noise introduced by transmitting station 2. As will be described, the coefficient decision circuit 15 derives optimum values of tap weights from the input signals from noise source 13 and subtractor 17 according to an algorithm and adaptively adjusts the tap coefficients of the transversal filter 14 so that an error sequence appearing at the output of subtractor 17 reduces to a minimum. The noise-cancelled digital speech signal at the output of subtractor 17 is converted by a digital-to-analog converter 18 to analog form and applied to the loudspeaker 5.

Figure 2:
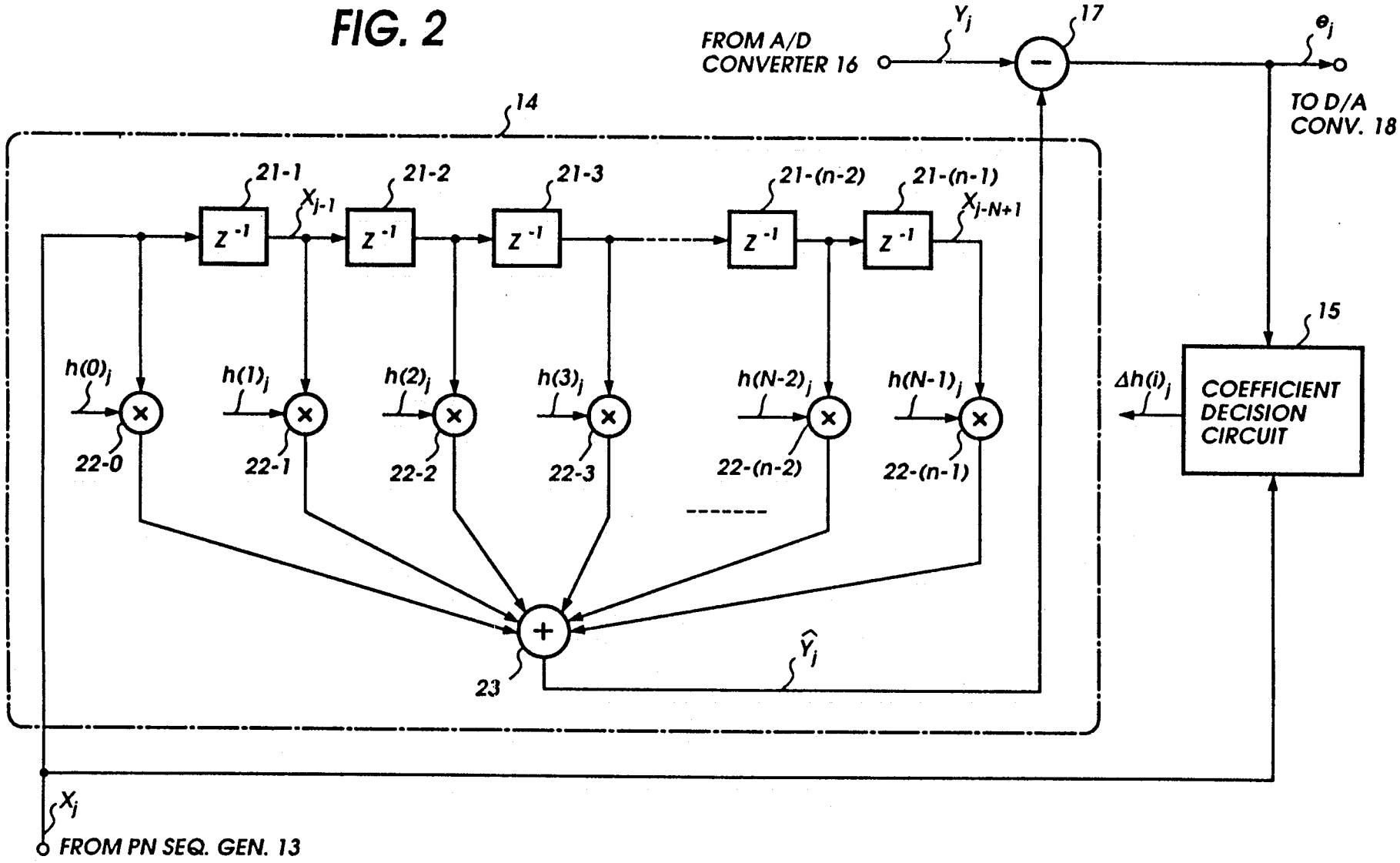
FIG. 2 is a circuit diagram of the adaptive transversal filter of FIG. 1.

As illustrated in FIG. 2, the adaptive transversal filter 14 of receiving station 4 comprises a tapped-delay line, or a shift register having (n−1) stages 21-1 through 21-(n−1) for successively introducing a unit delay time to digital input samples Xj supplied from pseudorandom number-sequence generator 13. A plurality of multipliers, or adjustable tap weights 22-0 through 22-(n−1) are connected to the delay line taps. The adjustable tap weights are respectively supplied with tap coefficients $h(0)_j$ through $h(N-1)_j$ which are sequentially corrected with correction terms $\Delta h(i)_j$ (each of which is equal to $k \cdot e_j \cdot X_j$, where k is a constant and $e_j$ is the error sequence ) from decision circuit 15 in order to adaptively adjust the tap weights of the filter in response to varying linear distortions such as carrier frequency deviation between transmit and receive carriers, differences in frequency and phase response characteristics between the two stations as well as timing difference between the source and local pseudorandom noise patterns generated respectively by generators 10 and 13. The outputs of tap weights 22-0 through 22-(n−1) are summed by an adder 23 to give an output which is expressed by:

$$Y_j = \sum_{i=0}^{N-1} h(i) \cdot X_{j-i}$$

The output of adder 23 is supplied as a noise prediction signal to the subtractor 17 to which the digital speech samples $Y_j$ from A/D converter 16 are supplied to derive the error sequence $e_j$. The number of tap weights 20-0 to 20-(n−1) is said to determine the length of the filter. For successful operation of the scrambled transmission, it is necessary that the filter length be greater than the number of bits contained in the interval between successive pseudorandom noise patterns. In this way, the output of adaptive transversal filter 14 substantially corresponds to the PN sequence generated by the scrambling noise source 10 and hence it cancels out the added noise without the need to synchronize the source and local PN sequence generators 10 and 13 with each other.

Figure 3A:
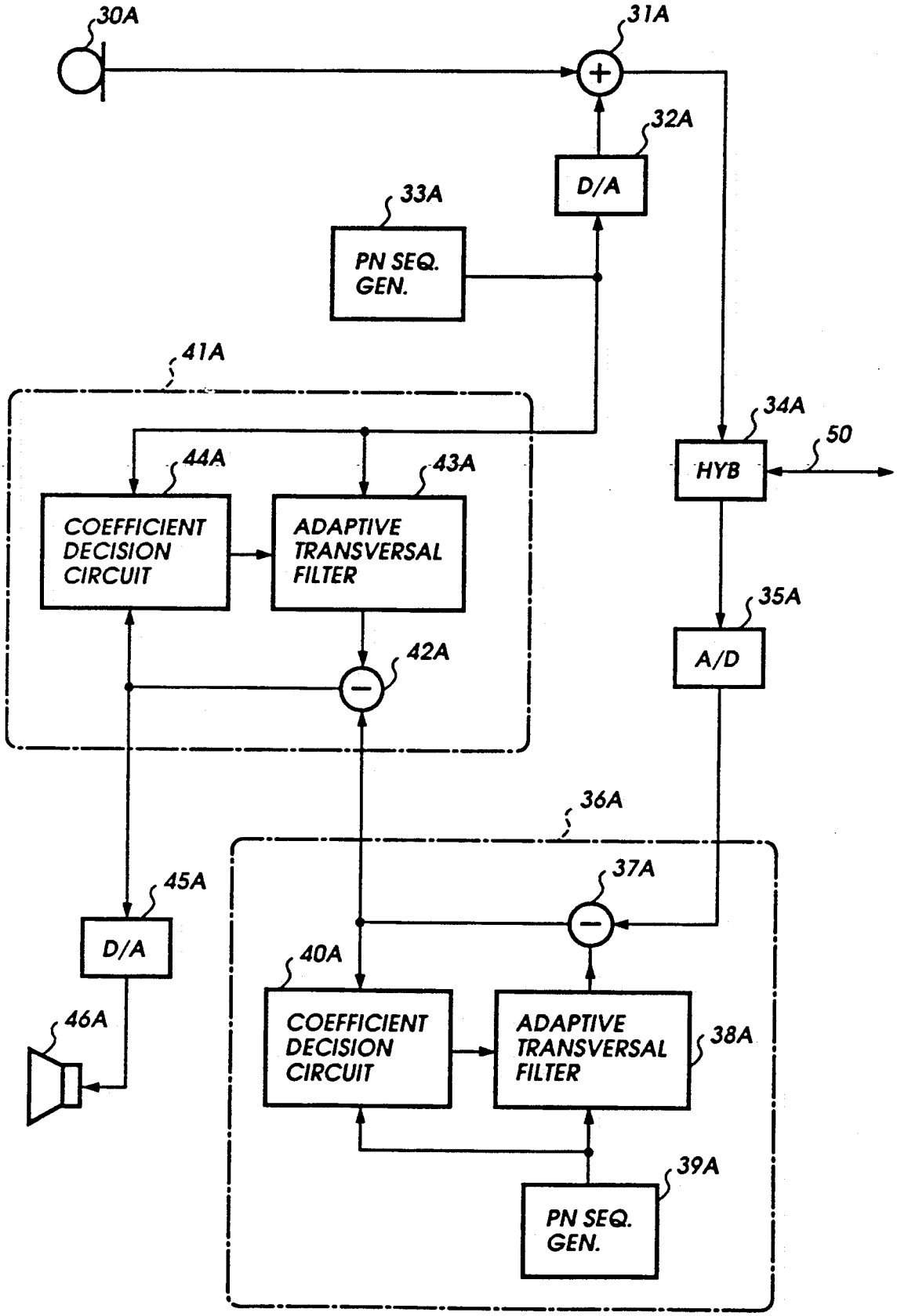
FIGS. 3A and 3B are block diagrams of a two-way scrambling/descrambling communication system according to a second embodiment of the present invention.
Figure 3B:
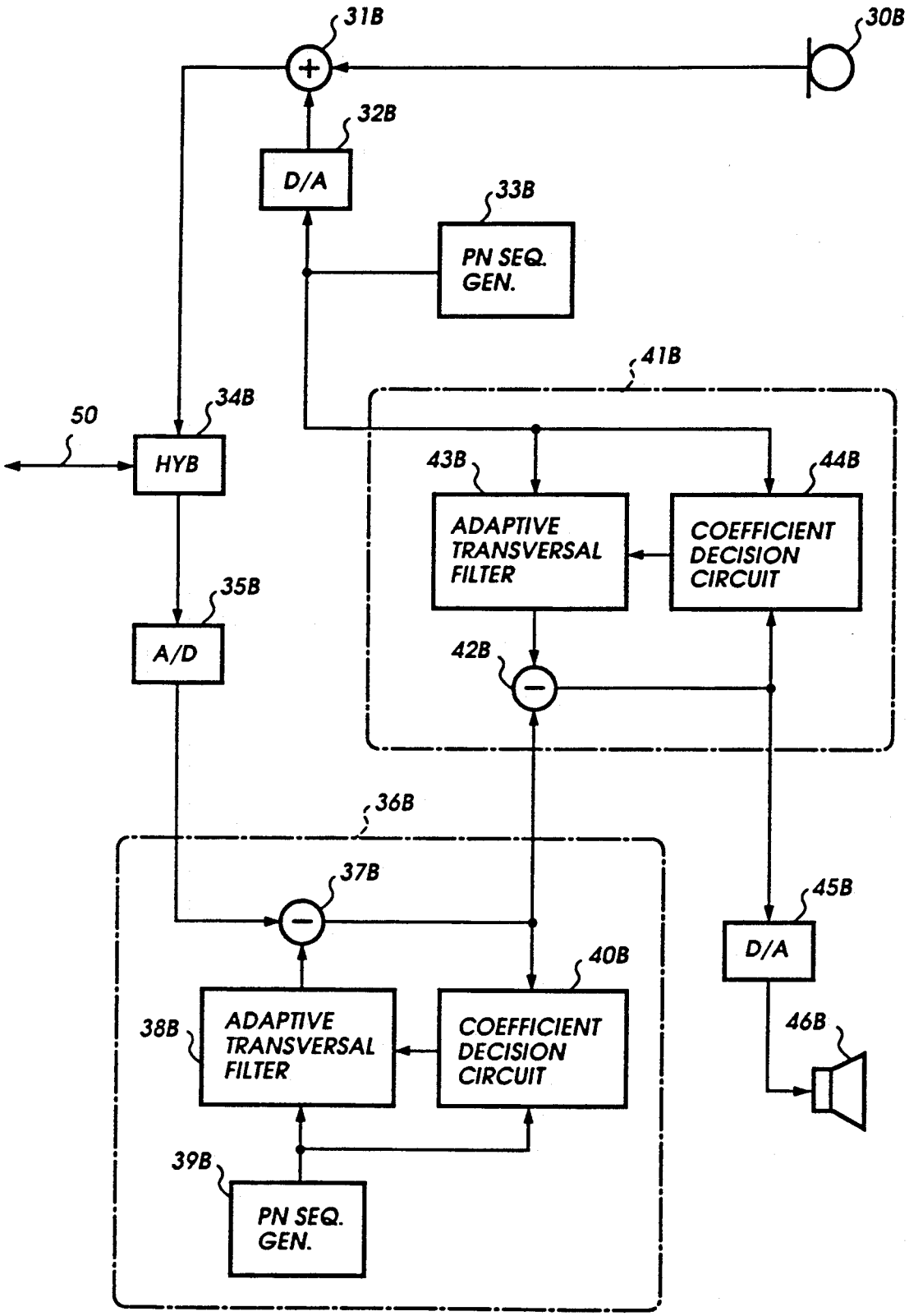

FIGS. 3A and 3B are block diagrams of stations A and B, respectively, for achieving a two-way scrambled transmission of speech signals according to a second embodiment of the invention. In FIG. 3A, station A comprises an adder 31A for summing a speech signal from a microphone 30A with pseudorandom noise supplied from a source PN sequence generator 33A/via a D/A converter 32A. The output of adder 31A is applied to one input port of a hybrid 34A and coupled to a transmission line 50 for transmission to station B.

A speech signal sent from station B via transmission line 50 is coupled through hybrid 34A to an A/D converter 35A and thence to a subtractor 37A of a noise canceller 36A. An adaptive transversal filter 38A receives pseudorandom noise patterns from a PN sequence generator 39A. A coefficient decision circuit 40A derives tap coefficients from the output of subtractor 37A as well as from the PN sequence from generator 39A for application to the transversal filter 38A to adaptively adjust its variable tap weights to cancel the pseudorandom noise introduced to the received speech signal. The output of subtractor 37 is thus free from the noise that has been intentionally added by the station B. The filter length of the transversal filter 38A is greater than the interval between successive series of pseudorandom bit patterns generated by the PN sequence generator 39A.

The output of subtractor 37A is further applied to an input of subtractor 42A of a second noise canceller 41A. The purpose of the second noise canceller 41A is to cancel noise which has been undesirably introduced to the received speech signal through a path known as transhybrid coupling by the hybrid 34A. To remove this noise component, adaptive transversal filter 43A and coefficient decision circuit 44A are supplied with the same PN sequence from PN sequence generator 33A as that added to the speech signal sent to the station B. Coefficient decision circuit 44A is further supplied with the output of subtractor 42A to generate the necessary tap coefficients for the transversal filter 43A. The output of subtractor 42A is therefore free from both noise components and converted to analog form by digital-to-analog converter 45A and applied to loudspeaker 46A.

As shown in FIG. 3B, station B is of identical construction to station A. Analog speech signal from microphone 30B is mixed with noise generated by PN sequence generator 33B and D/A converter 32B. PN sequence generator 33B is identical both in repetition frequency and pseudorandom noise pattern to PN sequence generator 39A of station A in order to permit the noise canceller 36A of station A to remove the noise introduced by station B. The output of adder 31B is transmitted to station A by coupling through hybrid 34B. Speech signals from station A, on the other hand, are coupled by hybrid 34B to A/D converter 35B for conversion to digital form and applied to subtractor 37B of noise canceller 36B which includes PN sequence generator 39B of construction identical in both repetition frequency and pseudorandom noise pattern to PN sequence generator 33A of station A. The output of PN sequence generator 39B is applied to adaptive transversal filter 38B and coefficient decision circuit 40B to which the output of subtractor 37B is also applied. The filter length of the transversal filter 38B is greater than the interval between successive series of pseudorandom bit patterns generated by the PN sequence generator 39B. The scrambling noise intentionally introduced to the speech signal from station A is now cancelled out by the subtractor 37B with the output of filter 38B, resulting in a replica of the original speech signal at station A. This replica is applied to subtractor 42B to further cancel the noise component undesirably introduced to the received signal by transhybrid coupling through hybrid 34B with a noise-cancelling signal that appears at the output of adaptive transversal filter 43B. This noise-cancelling signal is derived from the output of PN sequence generator 33B in response to varying tap coefficients from coefficient decision circuit 44B. The output of subtractor 42B is converted to analog form by D/A converter 45B and applied to loudspeaker 46B.

While mention has been made of speech-signal transmission, the present invention could equally be as well applied to facsimile signals. Various modifications are thus apparent to those skilled in the art without departing from the scope of the present invention which is only limited by the appended claims. Therefore, the embodiments shown and described are only illustrative, not restrictive.

What is claimed is:

1. A scrambled-communication system, comprising:

(a) a transmitting station including:

(i) source-noise generator means for generating a scrambling pseudorandom noise signal having a series of noise patterns; and (ii) adder means for adding said scrambling noise signal to an information signal to produce a scrambled signal; and (b) a receiving station including:

(i) subtractor means for receiving said scrambled signal and subtracting a noise-cancelling signal from the received signal to produce a subtractor output comprising a descrambled signal;

(ii) local-noise generator means for generating a descrambling pseudorandom noise signal having a series of noise patterns identical to that of said scrambling noise signal;

(iii) adaptive transversal filter means having a tapped-delay line connected to said local-noise generator means, a plurality of variable-tap weight multipliers connected respectively to taps of said tapped-delay line, and means for summing outputs of said tap weight multipliers and supplying summed outputs as said noise-cancelling signal to said subtractor means, said adaptive transversal filter having a tap length greater than an interval between successive series of said noise patterns of said descrambling noise signal; and means for deriving tap coefficients from said descrambling noise signal and from the subtractor output and varying said tap weight multipliers of said adaptive transversal filter means with the derived tap coefficients so that said noise-cancelling signal substantially corresponds to said scrambling noise signal.

2. A scrambled-communication system as claimed in claim 1, wherein spectral energy densities of said scrambling noise signal are substantially constant over a frequency spectrum of said information signal.

3. A scrambled-communication system comprising:

(a) a transmitting station including:

(i) source-noise generator means for generating a pseudorandom number sequence having a series of bit patterns;

(ii) digital-to-analog converter means for converting said pseudorandom number sequence to analog form; and (iii) adder means for adding an output of said digital-to-analog converter means to an analog information signal to produce a scrambled signal; and (b) a receiving station including:

(i) analog-to-digital converter means for converting said scrambled signal from said transmitting station to digital form;

(ii) subtractor means for subtracting a noise-cancelling signal from an output of said analog-to-digital converter means to produce a descrambled digital signal;

(iii) local-noise generator means for generating a pseudorandom number sequence having a series of bit patterns identical to that of said pseudorandom number sequence generated by said source-noise generator means;

(iv) adaptive transversal filter means having a tapped-delay line connected to said local-noise generator means, a plurality of variable-tap weight multipliers connected respectively to taps of said tapped-delay line, and means for summing outputs of said tap weight multipliers and supplying summed outputs as said noise-cancelling signal to said subtractor means, said adaptive transversal filter having a tap length which is greater than an interval between successive series of said bit patterns;

(v) means for deriving tap coefficients from said pseudorandom number sequence of said local-noise generator means and from an output of said subtractor means and varying said tap weight multipliers of said adaptive transversal filter means with the derived tap coefficients so that said noise-cancelling signal substantially corresponds to the pseudorandom number sequence generated by said source-noise generator means; and (vi) D/A converter means for converting said descrambled digital signal from said subtractor means to a descrambled analog signal.

4. A scrambled-communication system as claimed in claim 3, wherein spectral energy densities of said pseudorandom number sequence are substantially constant over a frequency spectrum of said analog information signal.

5. A scrambled-communication system comprising:

a first station including:

first source-generator means for generating a first scrambling noise signal having a series of noise patterns;

first adder means for adding said first scrambling noise signal to a first information signal to produce a first scrambled signal;

first hybrid means having a first port to which said first scrambled signal is applied and a second port, said first hydrid means coupling the signal at said first port to a transmission medium and coupling a signal from said transmission medium to said second port;

first subtractor means for subtracting a first noise-cancelling signal from the signal at said second port of said hybrid means;

first local-noise generator means for generating a first descrambling noise signal having a series of noise patterns;

first adaptive transversal filter means having a first tapped-delay line connected to said first local-noise generator means, a plurality of first variable tap weight multipliers connected respectively to taps of said first tapped-delay line, and means for summing outputs of said first tap weight multipliers and supplying summed outputs as said first noise-cancelling signal to said first subtractor means, said first adaptive transversal filter means having a tap length greater than an interval between successive series of said noise patterns of said first descrambling noise signal;

first coefficient-deriving means for deriving first tap coefficients from said first descrambling noise signal and from an output of said first subtractor means and varying said first tap weight multipliers of said first adaptive transversal filter means with the derived first tap coefficients;

second subtractor means for subtracting a second noise-cancelling signal from the output of said first subtractor means to produce a first descrambled signal;

second adaptive transversal filter means having a second tapped-delay line connected to said first source-noise generator means, a plurality of second variable tap weight multipliers connected respectively to taps of said second tapped-delay line, and means for summing outputs of said second tap weight multipliers and supplying summed outputs as said second noise-cancelling signal to said second subtractor means, said second adaptive tranversal filter means having a tap length greater than an interval between successive series of said noise patterns of said first scrambling noise;

second coefficient deriving means for deriving second tap coefficient from said first scrambling noise and from an output of said second subtractor means and varying the tap weight multipliers of said second adaptive transversal filter means with the derived second tap coefficients, and a second station including:

second source noise generator means for generating a second scrambling noise signal having a series of noise patterns substantially identical to said first descrambling noise signal of said first station;

second adder means for adding said second scrambling noise signal to a second information signal to produce a second scrambled signal;

second hybrid means having a first port to which said second scrambled signal is applied and a second port, said second hybrid means coupling the signal at said first port to said transmission medium and coupling a scrambled signal received from said transmission medium to said second port;

second local-noise generator means for generating a second descrambling noise signal having a series of noise patterns substantially identical to said first scrambling noise signal of said first station;

third subtractor means for subtracting a third noise-cancelling signal from the scrambled signal at said second port of said second hybrid means;

third adaptive transversal filter means having a third tapped-delay line connected to said second local-noise generator means, a plurality of third variable tap weight multipliers connected respectively to taps of said third tapped-delay line, and means for summing outputs of said third tap weight multipliers and supplying summed outputs as said third noise-cancelling signal to said third subtractor means, said third adaptive transversal filter having a tap length greater than an interval between successive series of said noise patterns of said first scrambling noise signal of said first station;

third coefficient-deriving means for deriving third tap coefficients from said second descrambling noise signal and from an output of said third subtractor means and varying said third tap weight mulipliers of said third adaptive transversal filter means with the derived third tap coefficients;

fourth subtractor means for subtracting a fourth noise-cancelling signal from the output of said third subtractor means to produce a second descrambled signal;

fourth adaptive transversal filter means having a fourth tapped-delay line connected to said second source-noise generator means, a plurality of fourth variable tap weight multipliers connected respectively to taps of said fourth tapped-delay line, and means for summing outputs of said fourth tap weight multipliers and supplying summed outputs as said fourth noise-cancelling signal to said fourth subtractor means, said fourth adaptive transversal filter having a tap length greater than an interval between successive series of said noise patterns of said second scrambling noise of said second station; and fourth coefficient-deriving means for deriving fourth tap coefficients from said second scrambling noise signal and from an output of said fourth subtractor means and varying the tap weight multipliers of said fourth adaptive transversal filter means with the derived fourth tap coefficients.

6. A scrambled-communication system as claimed in claim 5, wherein spectral densities of said first scrambling noise signal are substantially constant over a frequency spectrum of said first information signal and spectral energy densities of said second scrambling noise signal are substantially constant over a frequency spectrum of said second information signal.

7. A scrambling/descrambling station for two-way communication, comprising:

source-noise generator means for generating a first scrambling noise signal having a series of noise patterns;

adder means for adding said first scrambling noise signal to an information signal to produce a first scrambled signal;

hybrid means having a first port to which said first scrambled signal is applied and a second port, said hybrid means coupling the signal at said first port to a transmission medium and coupling to said second port a second scrambled signal received from a distant station via said transmission medium;

first subtractor means for subtracting a first noise-cancelling signal from the signal at said second port of said hybrid means;

local-noise generator means for generating a descrambling noise signal having a series of noise patterns;

first adaptive transversal filter means having a first tapped-delay line connected to said local-noise generator means, a plurality of first variable-tap weight multipliers connected respectively to taps of said first tapped-delay line, and means for summing outputs of said first tap weight multipliers and supplying summed outputs as said first noise-cancelling signal to said first subtractor means, said first adaptive transversal filter means having a tap length greater than an interval between successive series of noise patterns of said first descrambling noise signal;

first coefficient-deriving means for deriving first tap coefficients from said first descrambling noise signal and from an output of said first subtractor means and varying said first tap weight multipliers of said first adaptive transversal filter means with the derived first tap coefficients;

second subtractor means for subtracting a second noise-cancelling signal from the output of said first subtractor means to produce a second descrambled signal;

second adaptive transversal filter means having a second tapped-delay line connected to said source-noise generator means, a plurality of second variable tap weight multipliers connected respectively to taps of said second tapped-delay line, and means for summing outputs of said second tap weight multipliers and supplying summed outputs as said second noise-cancelling signal to said second subtractor means, said second adaptive transversal filter means having a tap length greater than an interval between successive series of said first noise patterns of said first scrambling noise signal; and second coefficient-deriving means for deriving second tap coefficients from said first scrambling noise signal and from an output of said second subtractor means and varying the tap weight multipliers of said second adaptive transversal filter means with the derived second tap coefficients.

8. A scrambling/descrambling station as claimed in claim 7, wherein spectral energy densities of said first scrambling noise signal are substantially constant over a frequency spectrum of said information signal.

9. A scrambling/descrambling station for two-way communication, comprising:

source-noise generator means for generating a scrambling pseudorandom number sequence having a series of bit patterns;

first digital-to-analog converter means for converting said scrambling pseudorandom number sequence to analog form;

adder means for adding said scrambling pseudorandom number sequence to an information signal to produce a first scrambled signal;

hybrid means having a first port to which said scrambled signal is applied and a second port, said hybrid means coupling the signal at said first port to a transmission medium and coupling to said second port a second scrambled signal received from a distant station via said transmission medium;

analog-to-digital converter means for converting the signal at said second port of said hybrid means to digital form;

first subtractor means for subtracting a first noise-cancelling signal from an output of said analog-to-digital converter means;

local-noise generator means for generating a descrambling pseudorandom number sequence having a series of bit patterns;

first adaptive transversal filter means having a first tapped-delay line connected to said local-noise generator means, a plurality of first variable tap weight multipliers connected respectively to taps of said first tapped-delay line, and means for summing outputs of said first tap weight multipliers and supplying summed outputs as said first noise-cancelling signal to said first subtractor means, said first adaptive transversai filter means having a tap length greater than an interval between successive series of bit patterns of said descrambling pseudorandom number sequence;

first coeffcient-deriving means for deriving first tap coefficients from said descrambling pseudorandom number sequence from an output of said first subtractor means and varying said first tap weight multipliers of said first adaptive transversal filter means with the derived first tap coefficients;

second subtractor means for subtracting a second noise-cancelling signal from the output of said first subtractor means to produce a descrambled signal;

second adaptive transversal filter means having a second tapped-delay line connected to said source-noise generator means, a plurality of second variable tap weight mutlipliers connected respectively to taps of said second tapped-delay line, and means for summing outputs of said second tap weight multipliers and supplying the summed outputs as said second noise-cancelling signal to said second subtractor means, said second adaptive transversal filters means having a tap length greater than an interval between successive series of said bit patterns of said scrambling pseudorandom number sequence;

second coefficient-deriving means for deriving second tap coefficients from said scrambling pseudorandom number sequence and from an output of said second subtractor means and varying the tap weight multipliers of said second adaptive transversal filter means with the derived second tap coefficients; and second D/A converter means connected to the output of said second subtractor means.

10. A scrambling/descrambling station as claimed in claim 9, wherein spectral energy densities of said scrambling pseudorandom number sequence are substantially constant over a frequency spectrum of said information signal.

* * * * *